US008215789B2

(12) United States Patent
Howard

(10) Patent No.: US 8,215,789 B2
(45) Date of Patent: Jul. 10, 2012

(54) LIGHT-EMITTING APPARATUS

(75) Inventor: Kenneth A. Howard, Creve Coeur, MO (US)

(73) Assignee: Mary Elle Fashions, St. Louis, MO (US)

( * ) Notice: Subject to any disclaimer, the term of this patent is extended or adjusted under 35 U.S.C. 154(b) by 553 days.

(21) Appl. No.: 12/466,220

(22) Filed: May 14, 2009

(65) Prior Publication Data

US 2010/0290238 A1 Nov. 18, 2010

(51) Int. Cl.
*F21V 35/00* (2006.01)
*F23Q 2/32* (2006.01)

(52) U.S. Cl. ..... 362/161; 362/157; 431/125

(58) Field of Classification Search ..... 362/157, 362/161, 392, 810, 806, 800; 431/125, 126, 431/253, 289, 288, 291
See application file for complete search history.

(56) References Cited

U.S. PATENT DOCUMENTS 3,890,085 A * 6/1975 Andeweg ..... 431/125
4,416,975 A 11/1983 Green
4,755,135 A 7/1988 Kwok
5,013,972 A 5/1991 Malkieli
5,057,005 A 10/1991 Kwok
5,924,784 A 7/1999 Chliwnyj
6,028,694 A 2/2000 Schmidt
6,053,622 A 4/2000 Horowitz
6,124,808 A 9/2000 Budnovitch
6,132,054 A 10/2000 Rogers
6,220,718 B1 4/2001 Burgess
6,241,362 B1 * 6/2001 Morrison ..... 362/231
6,488,494 B2 12/2002 Lee
6,491,516 B1 12/2002 Tal
6,520,770 B2 2/2003 Zou
6,616,308 B2 * 9/2003 Jensen et al. ..... 362/351
6,627,857 B1 * 9/2003 Tanner et al. ..... 219/445.1
6,672,738 B1 1/2004 Lewis
6,719,443 B2 4/2004 Gutstein
6,733,279 B2 5/2004 Thigpen
6,805,469 B1 10/2004 Barton
6,808,297 B2 10/2004 Jensen
6,819,080 B2 11/2004 Barbeau
6,851,827 B2 2/2005 Clemente
6,929,379 B2 8/2005 Clemente
6,929,381 B2 8/2005 Peterson
6,981,786 B2 1/2006 Yao
7,065,910 B2 6/2006 Woodruff
7,093,961 B2 * 8/2006 Bentley et al. ..... 362/355
7,098,600 B2 8/2006 Li
7,118,235 B2 10/2006 Barton
7,118,243 B2 * 10/2006 McCavit et al. ..... 362/161
7,121,686 B1 * 10/2006 Chu ..... 362/234
7,182,489 B2 2/2007 Yao (Continued)

OTHER PUBLICATIONS

Norex Enterprises, Inc., NorexPro Safelite, It's The Norex(R) Candle!, 5 web pages.

(Continued)

*Primary Examiner* — Ali Alavi
(74) *Attorney, Agent, or Firm* — Senniger Powers LLP

(57) ABSTRACT

A light-emitting apparatus includes a housing defining an interior space. A light-emitting diode in the interior space of the housing projects upward from the interior bottom surface. A support surface in the interior space above the light-emitting diode is configured to support a candle in the interior space over the light-emitting diode so that the light-emitting diode is hidden from view.

14 Claims, 10 Drawing Sheets

U.S. PATENT DOCUMENTS

| | | | | |
|---|---|---|---|---|
| 7,201,500 | B2 | 4/2007 | Mishan | |
| 7,204,619 | B2 | 4/2007 | Sherer | |
| 7,252,423 | B1 | 8/2007 | Wang | |
| 7,261,455 | B2 | 8/2007 | Schnuckle | |
| 7,360,918 | B2 | 4/2008 | Trombetta | |
| 7,360,930 | B2 * | 4/2008 | Yu | 362/392 |
| 7,360,935 | B2 * | 4/2008 | Jensen et al. | 362/555 |
| 7,377,667 | B2 | 5/2008 | Richmond | |
| 7,387,411 | B1 | 6/2008 | Tsai | |
| 7,458,698 | B2 | 12/2008 | Heathcock | |
| 7,614,767 | B2 * | 11/2009 | Zulim et al. | 362/296.01 |
| 7,997,772 | B2 * | 8/2011 | Avtzon et al. | 362/392 |
| 2002/0086567 | A1 * | 7/2002 | Cash, Jr. | 439/106 |
| 2004/0207341 | A1 * | 10/2004 | Callahan | 315/291 |
| 2004/0246744 | A1 * | 12/2004 | Krupa et al. | 362/574 |
| 2005/0122065 | A1 * | 6/2005 | Young | 315/294 |
| 2005/0174473 | A1 * | 8/2005 | Morgan et al. | 348/370 |
| 2005/0180148 | A1 * | 8/2005 | Ham et al. | 362/447 |
| 2006/0046220 | A1 * | 3/2006 | Lin | 431/253 |
| 2006/0172239 | A1 * | 8/2006 | Tsai | 431/253 |
| 2007/0003894 | A1 * | 1/2007 | Yu | 431/289 |
| 2007/0014107 | A1 * | 1/2007 | Mishan | 362/190 |
| 2007/0159844 | A1 | 7/2007 | Wang | |
| 2008/0197790 | A1 * | 8/2008 | Mangiaracina et al. | 315/312 |
| 2010/0127634 | A1 * | 5/2010 | Dowling et al. | 315/291 |

OTHER PUBLICATIONS

Norex Enterprises, Inc., NorexPro SafeLite, The 24 Hour Rechargeable Candle A Flameless, Flickering, Electronic Votive Candle That Lasts for Years!, 8 web pages.

Norex Enterprises, Inc., Norex Candle Lamps, 19 web pages.

Norex Enterprises, Inc., NorexPro SafeLite(TM), 3 web pages.

Norex Enterprises, Inc., Flickering SmartLite(TM) and Candlites(TM), 4 web pages.

Norex Enterprises, Inc., Norex(R) Candle Lamps, 4 web pages.

Norex Enterprises, Inc., Electronic Rechargeable Candles, Candle Lamps and Candelabras, 2 web pages.

Norex Enterprises, Inc., SmartLight(TM), Tabletop Model, 4 web pages.

International Search Report, mailed Jul. 14, 2010, regarding PCT/US2010/034867, 3 pages.

* cited by examiner

LIGHT-EMITTING APPARATUS

FIELD OF THE INVENTION

The present invention generally relates to light-emitting apparatus, and more particularly, to a light-emitting apparatus including a LED.

BACKGROUND

An LED candle is not truly a "candle" in a traditional sense because the LED candle does not comprise a wick and a flammable fuel, such as wax or tallow, for producing light. Instead, an LED candle is a light-emitting apparatus that resembles a candle, but includes an LED as the light source in lieu of a wick and a flammable fuel. One type of known LED candle includes an LED that is formed integral with a housing that resembles a candle. This type of LED candle is used solely as an LED candle. Another type of LED candle is a system that includes a housing resembling a candle, a small candle (e.g., a tealight candle) and a small LED candle (e.g., an LED candle resembling a tealight candle). Each of the candle and the LED candle can be inserted into the housing and used as the light source, but only one can be placed in the housing at one time. Accordingly, if the LED candle is in the housing and a user wants to switch to the candle, the user has to remove the LED candle from the housing and then insert the candle. Likewise, if the user wants to switch back to the LED candle, the user must remove the candle and then reinsert the LED candle.

In addition to light-emitting apparatus that resemble candles (i.e., LED candles), there are also light-emitting apparatus that resemble lanterns or other light-emitting devices that traditionally include a candle to produce light. Instead of candle, however, these light-emitting devices include an LED to produce light. As with the LED candles, a user can replace an LED candle in the light-emitting apparatus with a candle, and vice versa.

SUMMARY OF THE INVENTION

In one aspect, a light-emitting apparatus generally comprises a housing defining an interior space. A light-emitting diode in the interior space of the housing projects upward from the interior bottom surface. A support surface in the interior space above the light-emitting diode is configured to support a candle in the interior space over the light-emitting diode so that the light-emitting diode is hidden from view.

In another aspect, a light-emitting apparatus generally comprises a housing having an appearance of a candle. The housing has an interior space extending through a top of the housing. A support surface in the interior space of the housing supports a candle thereon. An LED-receiving recess is disposed below the support surface. An LED is in the LED-receiving recess. An entirety of the LED is disposed below the support surface so that a candle can be supported on the support surface in a position over the LED.

In yet another aspect, a light-emitting apparatus generally comprises a housing defining an interior space. A light-emitting diode is in the interior space of the housing. A candle support is adapted to be removably received in the interior space and to support a candle over the LED in the interior space of the housing.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
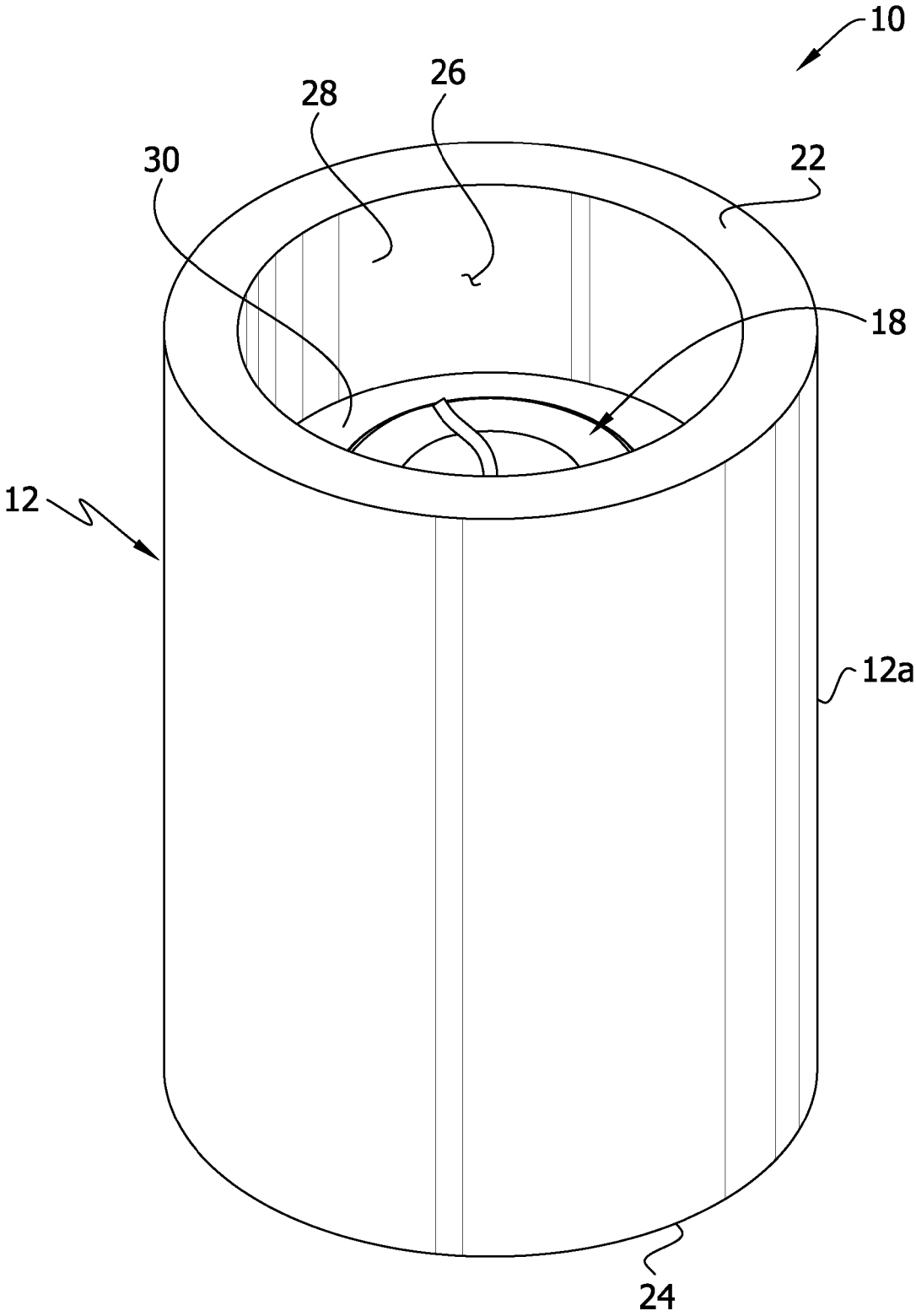
FIG. 1 is a perspective of a first embodiment of a light-emitting apparatus.
Figure 2:
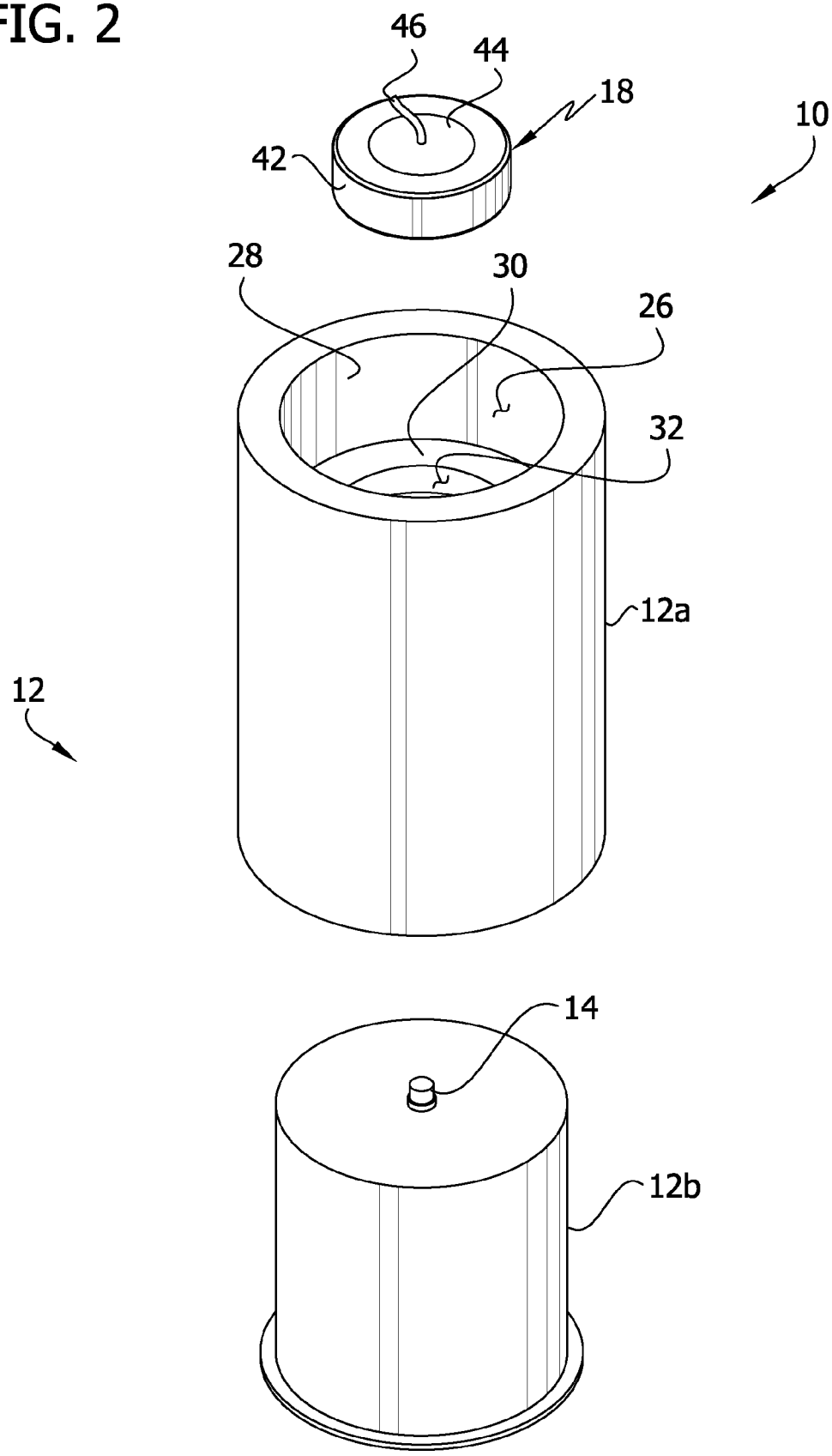
FIG. 2 is a partial exploded view of the first embodiment of the light-emitting apparatus.
Figure 3:
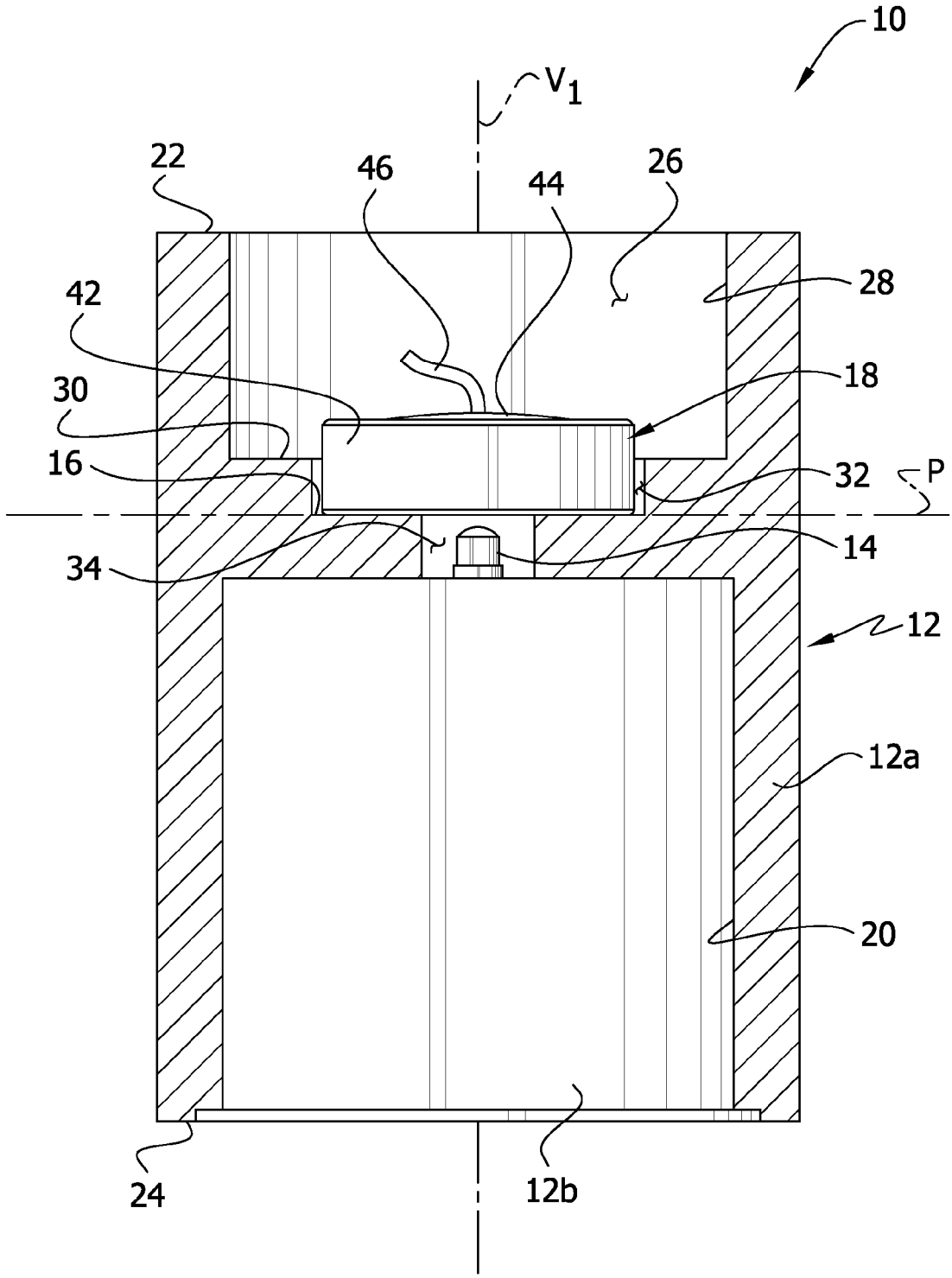
FIG. 3 is a longitudinal section of an outer housing component of the first embodiment of the light-emitting apparatus, including a tealight candle and an inner housing component received in the outer housing component.

Referring to FIGS. 1-4, a first embodiment of a light-emitting apparatus is generally indicated at 10. The light-emitting apparatus comprises a housing, generally indicated at 12, having an appearance of a candle, and a light-emitting diode (LED) 14 (FIGS. 2-4) in the housing for producing light. Referring to FIG. 3, in general the housing 12 includes a support surface 16 disposed above the LED 14 for supporting a removable candle 18 over the LED in the housing so that the LED is hidden from view. For purposes of this disclosure, a "candle" is a light source that comprises a source of flammable fuel and a wick to produce a flame. The drawings and the following description detail one exemplary configuration of this embodiment of the invention with the understanding that other configurations of this embodiment of the light-emitting apparatus do not fall outside the scope of the present invention.

The housing 12 may be at least partially constructed of wax to further give the housing an appearance of a candle. In the illustrated embodiment, as shown best in FIGS. 2 and 3, the housing 12 includes a cylindrical outer housing component 12*a* that is constructed of wax and a cylindrical inner housing component 12*b* that is formed from a generally rigid material, such as plastic. As explained below, the inner component 12*b* houses electrical components of the light-emitting apparatus 10. The inner housing component 12*b* is slidably received in a lower cavity 20 (FIG. 3) in the outer housing component 12*a*. It is understood that the housing 12 does not have to be at least partially constructed of wax, and other ways of giving the candle an appearance of a candle do not depart from the scope of the present invention.

Referring to FIG. 3, the housing 12 has an imaginary vertical axis $V_1$ extending through a top 22 and a bottom 24. An upper cavity 26 extends axially through the top 22 of the housing 24, more specifically, the outer housing component 12*a*. The upper cavity 26 is defined by an interior lateral surface 28 and an interior bottom surface 30. A candle-receiving recess 32 is recessed from the interior bottom surface 30 of the upper cavity 26 and is partially defined by the support surface 16. The candle-receiving recess 32 is sized and shaped to retain a candle therein, as will be explained. An LED-receiving recess 34, in which the LED 14 is disposed, is recessed from the support surface 16. In the illustrated embodiment, the upper cavity 26, the candle-receiving recess 32 and the LED-receiving recess 34 are generally coaxial with one another and are generally coaxial with the vertical axis $V_1$ of the housing 12. Together, the upper cavity 26, the candle-receiving recess 32 and the LED-receiving recess 34 define an interior space of the housing 12. In one example, the interior space, including the cavity 26 and the candle-receiving and LED-receiving recesses 32, 34, may be formed by boring and counter boring a solid stock of wax. It is understood that the cavity 26 and the candle-receiving and LED-receiving recesses 32, 34 may have other configurations and may be formed in other ways without departing from the scope of the present invention.

Referring to FIG. 3, the LED 14 is secured in the LED-receiving recess 34 in the housing 12. In the illustrated embodiment, the LED 14 extends upward from the inner housing component 12*b* and into the LED-receiving recess 34. In the illustrated embodiment, the support surface 16 lies in a transverse plane P. An entirety of the LED 14 is disposed below the transverse plane P in that the LED does not extend through the plane. Accordingly, when the candle 18 is placed on the support surface 16, the candle overlies the LED 14. It is understood that light-emitting apparatus 10 may include more than one LED 14.

Figure 4:
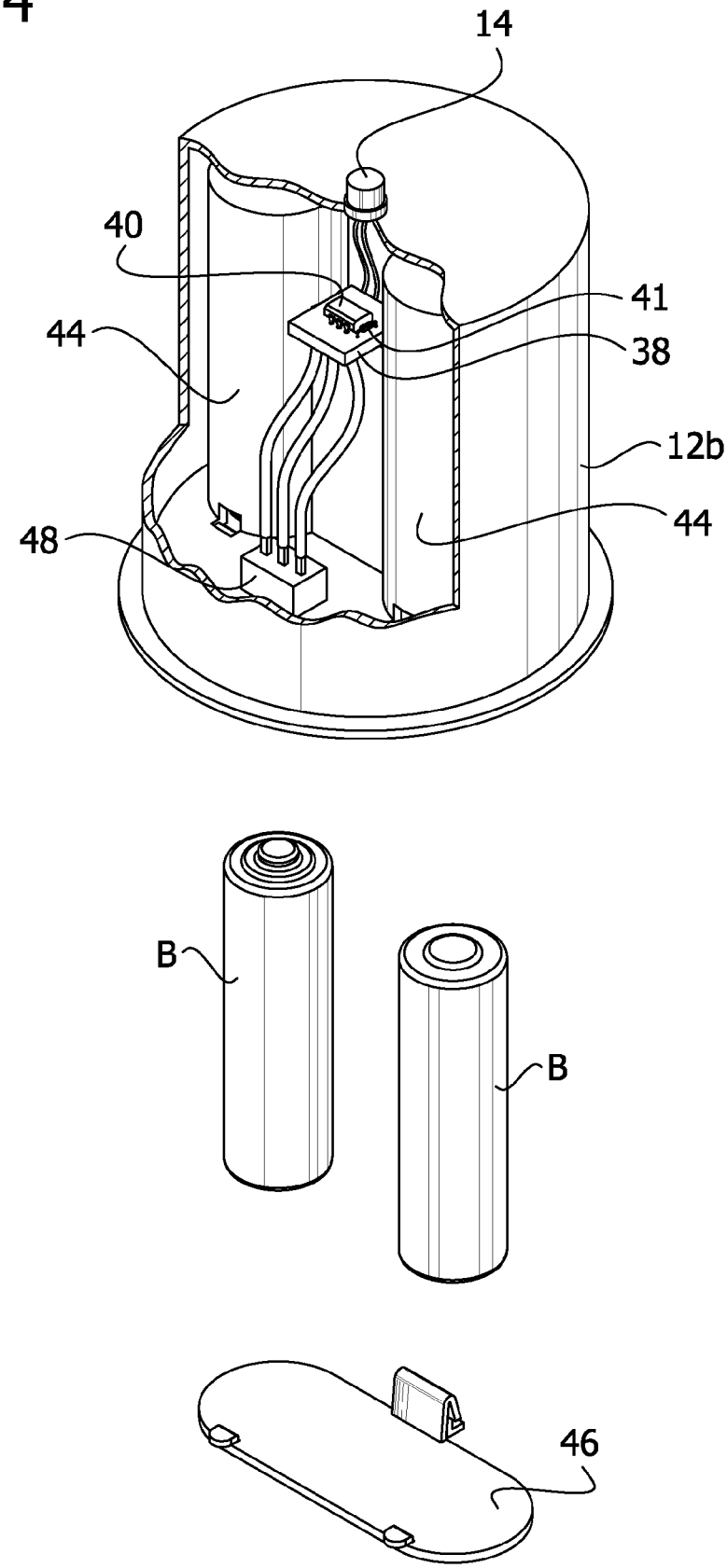
FIG. 4 is a perspective of the inner housing component with batteries exploded from the inner housing component and a portion of a wall of the inner housing component broken away to expose internal components.
Figure 5:
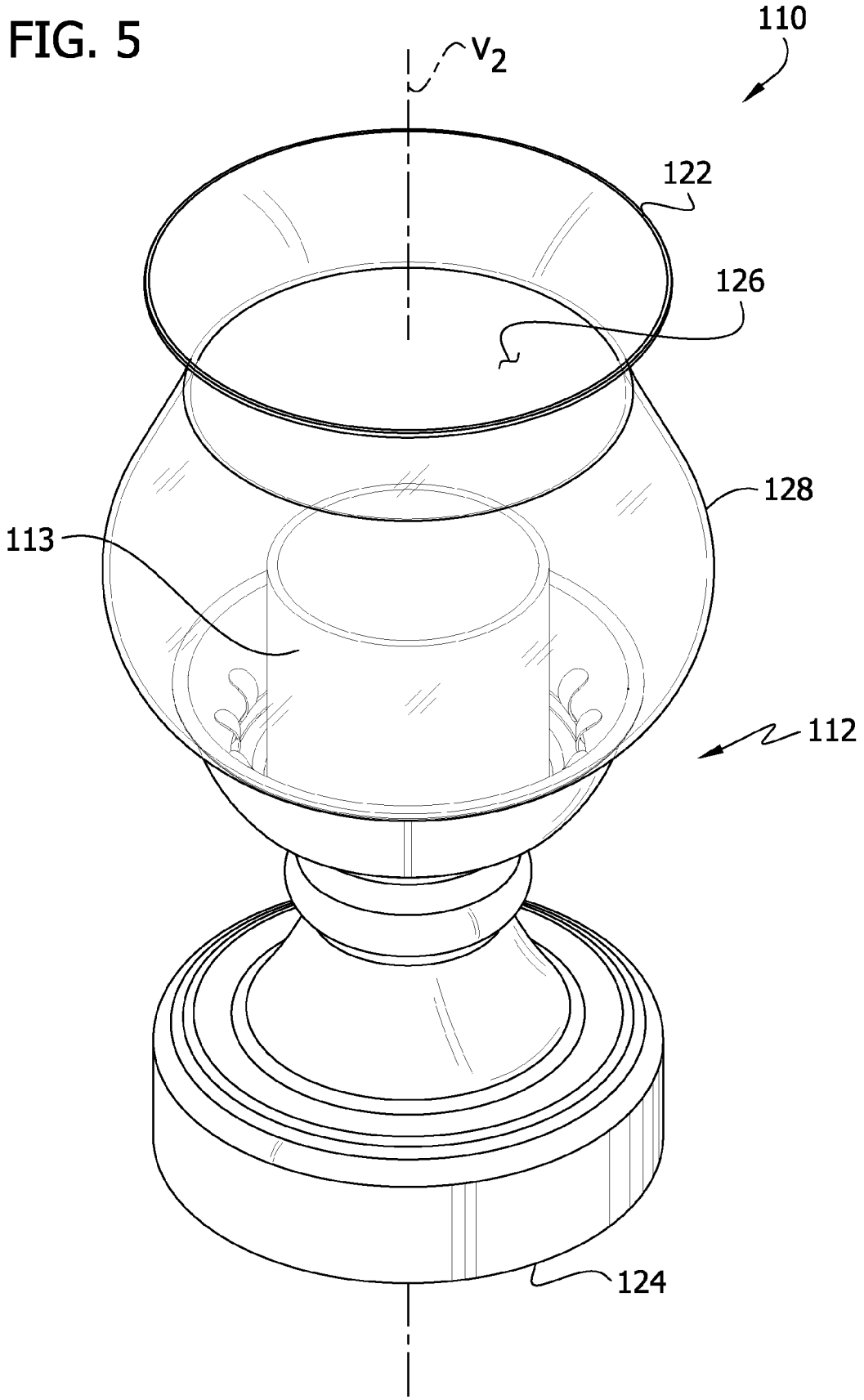
FIG. 5 is a perspective of a second embodiment of a light-emitting apparatus.

Referring to FIG. 4, in the illustrated embodiment the LED 14 is electrically connected to a circuit board 38, such as by electrical wires. The circuit board 38 is disposed within the inner housing component 12*b* so that it hidden from view. Referring still to FIG. 4, a driver circuit includes a controller 40 and a resistor 41 mounted on the circuit board 38 in electrical connection with the LED 14. The LED 14 and the controller 40 are powered by one or more batteries B in the housing 12 electrically connected to the circuit board 3 8. It is understood that LED 14 may be powered by a power source other than batteries. The driver circuit, including the controller 40 and a resistor 41, is configured to modulate, by pulse-width modulation, a duty cycle from the batteries B to control the amount of power supplied to the LED 14 so that the LED flickers. The flickering of the LED 14 resembles a flickering flame of a candle. Other ways of modulating the duty cycle of a power source to produce a flickering light do not depart from the scope of the present invention. Moreover, the LED 14 may not flicker without departing from the scope of the invention. The light-emitting apparatus may be constructed in other ways to power the LED without departing from the scope of the present invention.

Referring to FIG. 4, two battery receptacles 44 electrically connected to the LED 14 are secured in the housing 12 below the interior bottom surface 30. In the illustrated embodiment, each battery receptacle 44 is adapted to receive and electrically connect an AA battery B ("double-A battery") to the LED 14. One or more removable covers 46 (one being illustrated) at the bottom 24 of the housing 12 allow access to the battery receptacles 44 for inserting and replacing the batteries B. An on/off switch 48 at the bottom 24 of the housing 12 allows a user to turn the LED 14 on and off. It is understood that the light-emitting apparatus 10 may include one or more than two battery receptacles 44, the on/off switch 48 may be arranged in other ways and the housing 12 may include other types of battery receptacles for receiving other types of batteries without departing from the scope of the present invention.

Referring to FIG. 3, the candle-receiving recess 32 preferably has a size and shape that generally corresponds to a cross-sectional size and shape of the candle 18 to be received in the recess. Moreover, a depth of the candle-receiving recess 32 is preferably less than a height of the candle 18 so that the candle can be easily removed from the recess. In the illustrated embodiment, the candle-receiving recess 32 has a generally cylindrical shape for receiving and retaining a generally cylindrical candle 18 over the LED 14. It is understood that the candle-receiving recess 32 may be of other shapes and sizes for holding a candle of various shapes and sizes. More specifically, the candle-receiving recess 32 in the illustrated embodiment accommodates a tealight candle comprising a generally cylindrical container 42, such as a metal or plastic container, containing fuel 44 (e.g., wax) and a wick 46. The tealight candle 18 has a diameter in a range of about 0.75 in (1.91 cm) to about 1.50 in (3.81 cm), and may have a height in a range of about 0.40 in (1.02 cm) to about 1.0 in (2.54 cm). In one example, a diameter of the candle-receiving recess 32 is slightly larger than 1.5 in, such as within a range of about 1.6 in and 2.5 in. Moreover, the depth of the candle-receiving recess 32 is preferably less than about 0.40 in (1.02 cm), which is believed to be one of the smallest height available for a tealight candle. As can be seen in FIG. 3, when the tealight candle 18 is received in the candle-receiving recess 32 of the illustrated embodiment, the candle is retained in the recess and a flat bottom of the candle 18 covers the LED 14 and the LED-receiving recess and preferably does not contact the LED.

In use, either the LED 14 or the candle 18 can be used to produce light emitting from the light-emitting apparatus 10. It is envisioned that the LED 14 is normally used to produce the light, and if the user so chooses, the candle 18 (e.g., a standard tealight candle) can be placed in the candle-receiving recess 32 to produce light. In either case, the light-emitting apparatus 10 has the appearance of a regular, one-piece candle rather than an apparatus with an LED in a housing or a candle in a housing.

Referring to FIGS. 4-8, a second embodiment of a light-emitting apparatus is generally indicated at 110. The light-emitting apparatus 110 of the second embodiment generally comprises a housing 112 shaped as a candle holder, and an LED 114 (broadly, a LED) in the housing for producing light. A tubular faux candle 113 with open opposite longitudinal ends surrounds the LED 114 to give the appearance the faux candle is a wax candle received in the candle holder. The drawings and the following description detail one exemplary configuration of this embodiment of the invention with the understanding that other configurations of this embodiment of the light-emitting apparatus do not fall outside the scope of the present invention.

Figure 6:
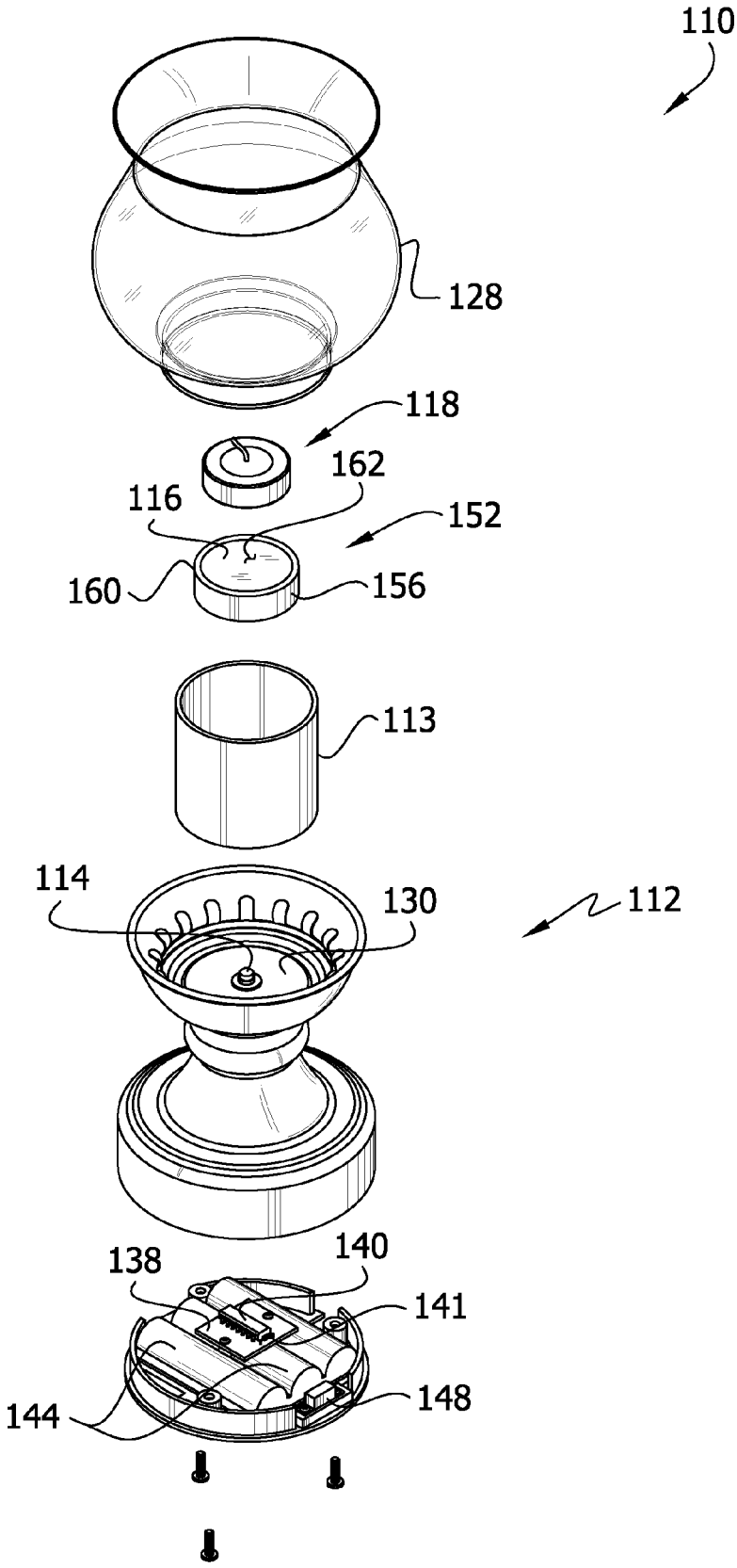
FIG. 6 is an exploded view of the second embodiment of the light emitting apparatus in FIG. 5.
Figure 7:
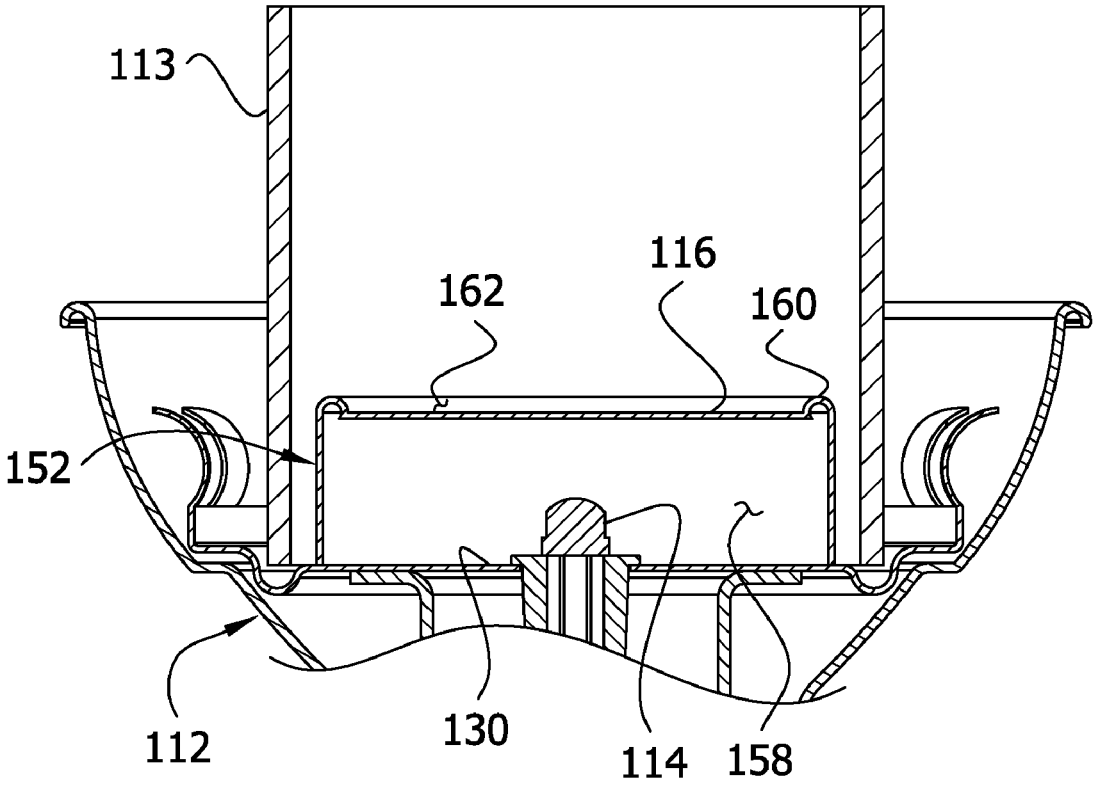
FIG. 7 is an enlarged, fragmentary longitudinal section of the second embodiment of the light-emitting apparatus.
Figure 8:
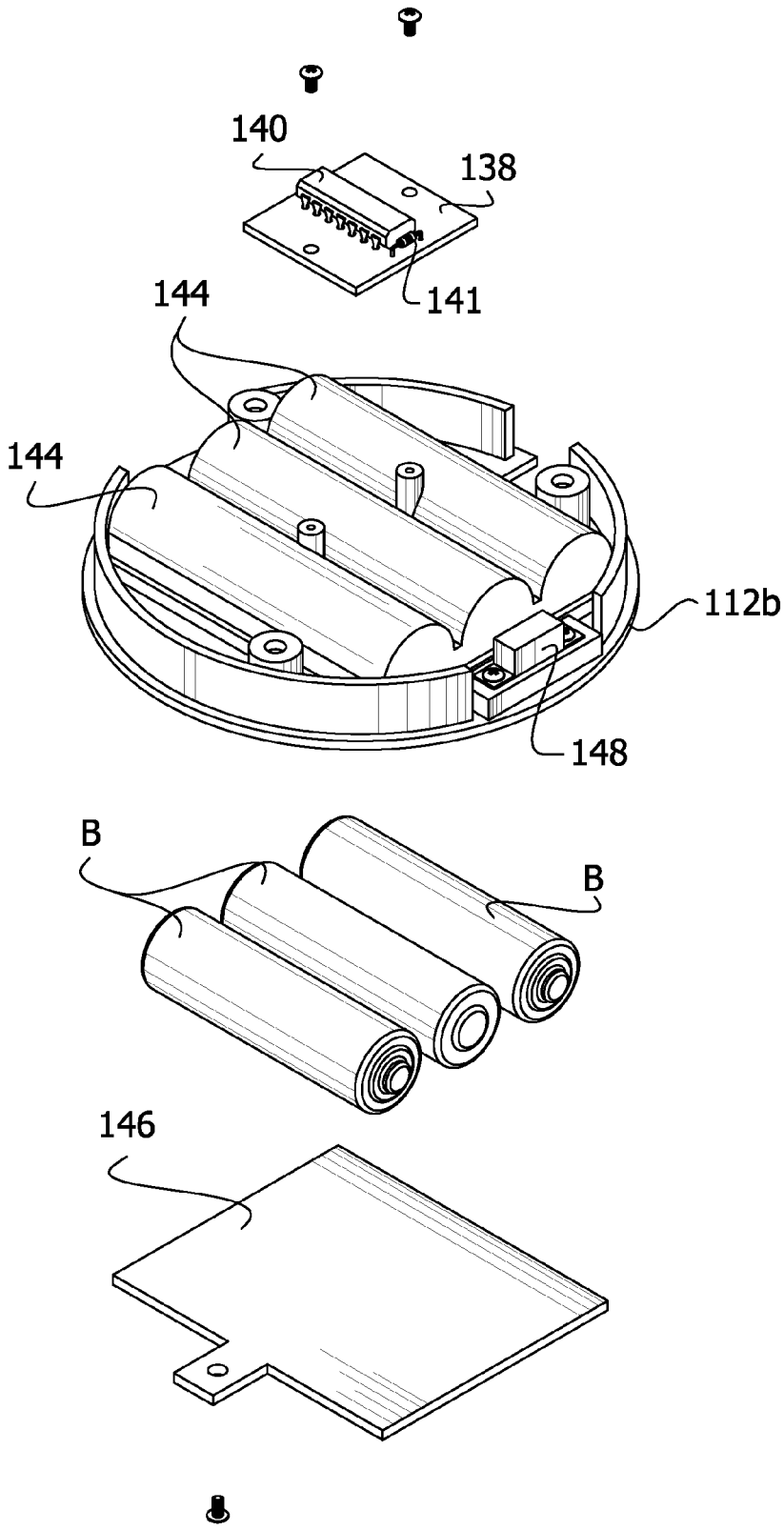
FIG. 8 is an enlarged perspective of battery receptacles of the second embodiment of the light-emitting apparatus, including batteries and a circuit board exploded therefrom.

In the illustrated embodiment, the housing 112 extends along an imaginary vertical axis $V_2$ and has a top 122 and a bottom 124. An interior space 126 is defined by a transparent, cylindrical wall or cover 128 and a bottom interior surface 130. Referring to FIGS. 6 and 7, the LED 114 is secured in the interior space 126 of the housing 112. In the illustrated embodiment, the LED 114 is electrically connected to a circuit board 138 and extends upward through an opening in bottom interior surface 130. It is understood that light-emitting apparatus 110 may include more than one LED 114 and that other types of LEDs, other than LEDS, may be used to produce light from within the housing 12.

In the illustrated embodiment, the LED 114 is electrically connected to the circuit board 138 by electrical wires, and the circuit board is disposed below the interior bottom surface 130 in the housing 112 so that it hidden from view. As shown best in FIG. 8, a driver circuit includes a controller 140 and a resistor 141 mounted on the circuit board 138 in electrical connection with the LED 114. The LED 114 and the controller 140 are powered by one or more batteries B in the housing 112 electrically connected to the circuit board 138. It is understood that the source of power may be a power source other than batteries. The driver circuit, including the controller 140 and the resistor 141, is configured to modulate, by pulse-width modulation, a duty cycle from the batteries B to control the amount of power supplied to the LED 114 so that the LED flickers. The flickering of the LED 114 resembles a flickering flame of a candle. The resistor 141 conditions the duty signal. Other ways of modulating the duty cycle of a power source to produce a flickering light do not depart from the scope of the present invention. Moreover, the LED 114 may not flicker without departing from the scope of the invention. Other components for operating the LED 114 may be mounted on the circuit board 38 without departing from the scope of the present invention.

At least one battery receptacle 144, which is electrically connected to the LED 114, is secured in the housing 112 below the interior bottom surface 130. In the illustrated embodiment, the circuit board 138 is mounted on the battery receptacles 144. The illustrated light-emitting apparatus 110 includes three battery receptacles for receiving three AA batteries. One or more removable battery covers 146 (one being illustrated) at the bottom 124 of the housing 112 allow access to the battery receptacles 144 for inserting and replacing the batteries B. An on/off switch 148 at the bottom 24 of the housing 12 allows a user to turn the LED 114 on and off. It is understood that battery receptacles 144 and the on/off switch 148 may be arranged in other ways and the housing 112 may include other types of battery receptacles for receiving other types of batteries without departing from the scope of the present invention.

Referring to FIGS. 6 and 7, the light-emitting apparatus 110 also comprises a candle support, generally indicated at 152, configured to be removably placed in the tubular faux wax candle 113 and to both cover the LED 114 and support a candle 118 over the LED. The candle support has an upper support surface 116 for supporting the candle 118 above the LED 114 in the interior space 126. A stand in the form of a skirt 156 extends downward from the upper support surface 116 and defines a cylindrical cavity 158. It is understood that the stand may be configured in other ways, besides the skirt, including being configured in such a way that does not hide the LED from view, without departing from the scope of the invention. The cylindrical cavity 158 is sized and shaped to receive the LED 114 when the candle support is placed over the LED so that the LED is hidden from view. In other words, the skirt 156 contacts the interior bottom surface 130 and has an interior height defining the cavity 158 that is sufficient for the upper portion to extend over the LED 114. The support surface 116 is recessed from an upper peripheral edge margin 160 of the candle support 152 to define a candle-receiving recess 162 for receiving and retaining the candle 118 on the support surface 116. As such, when the candle support 152 is placed over the LED 114, the candle 118 can be placed in candle-receiving recess 162 and on the support surface 116 so that the candle overlies the LED 114. The candle support 152 can be formed from metal or other materials without departing from the scope of the invention.

Figure 9:
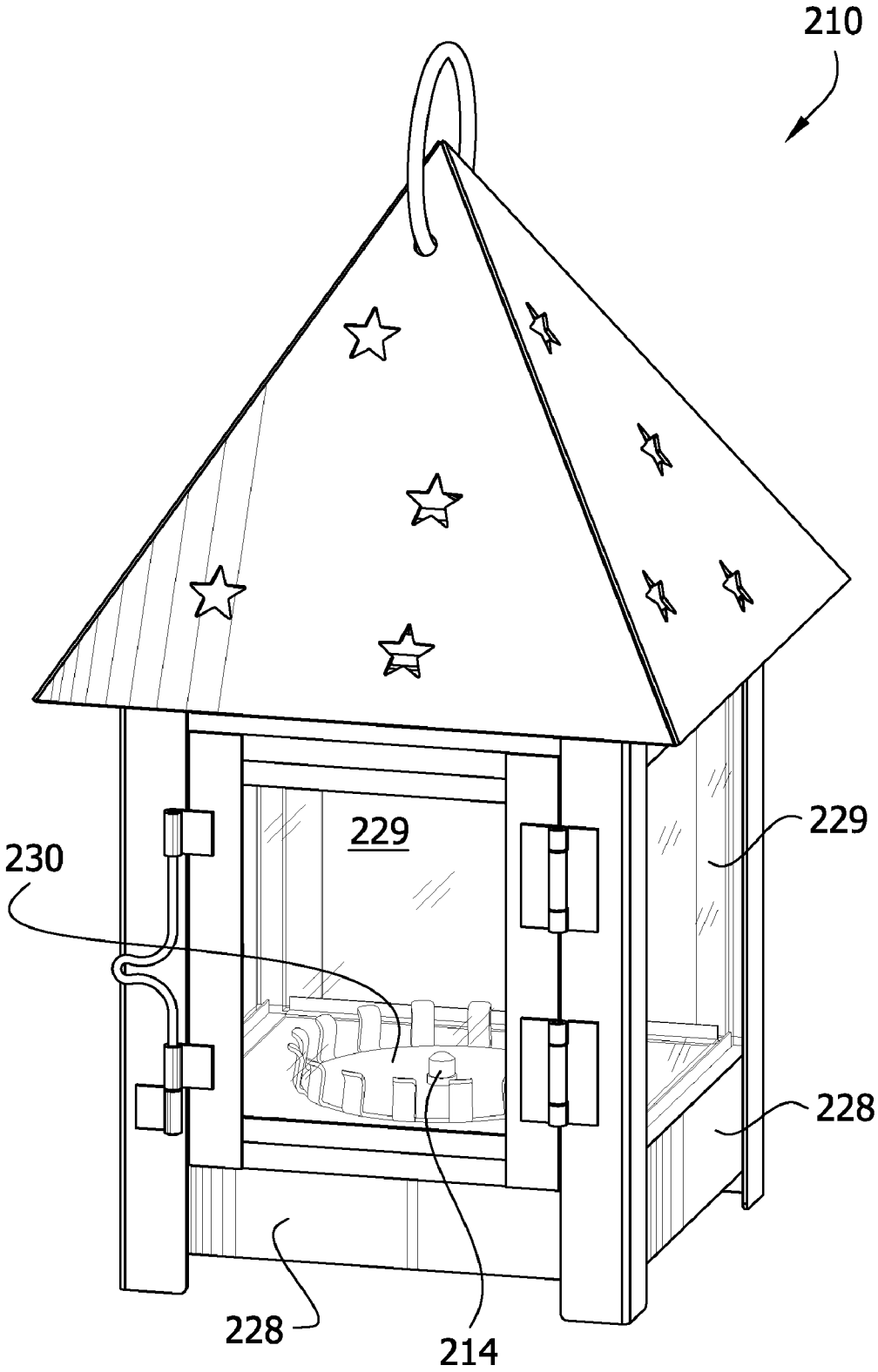
FIG. 9 is a perspective of a third embodiment of a light-emitting apparatus.
Figure 10:
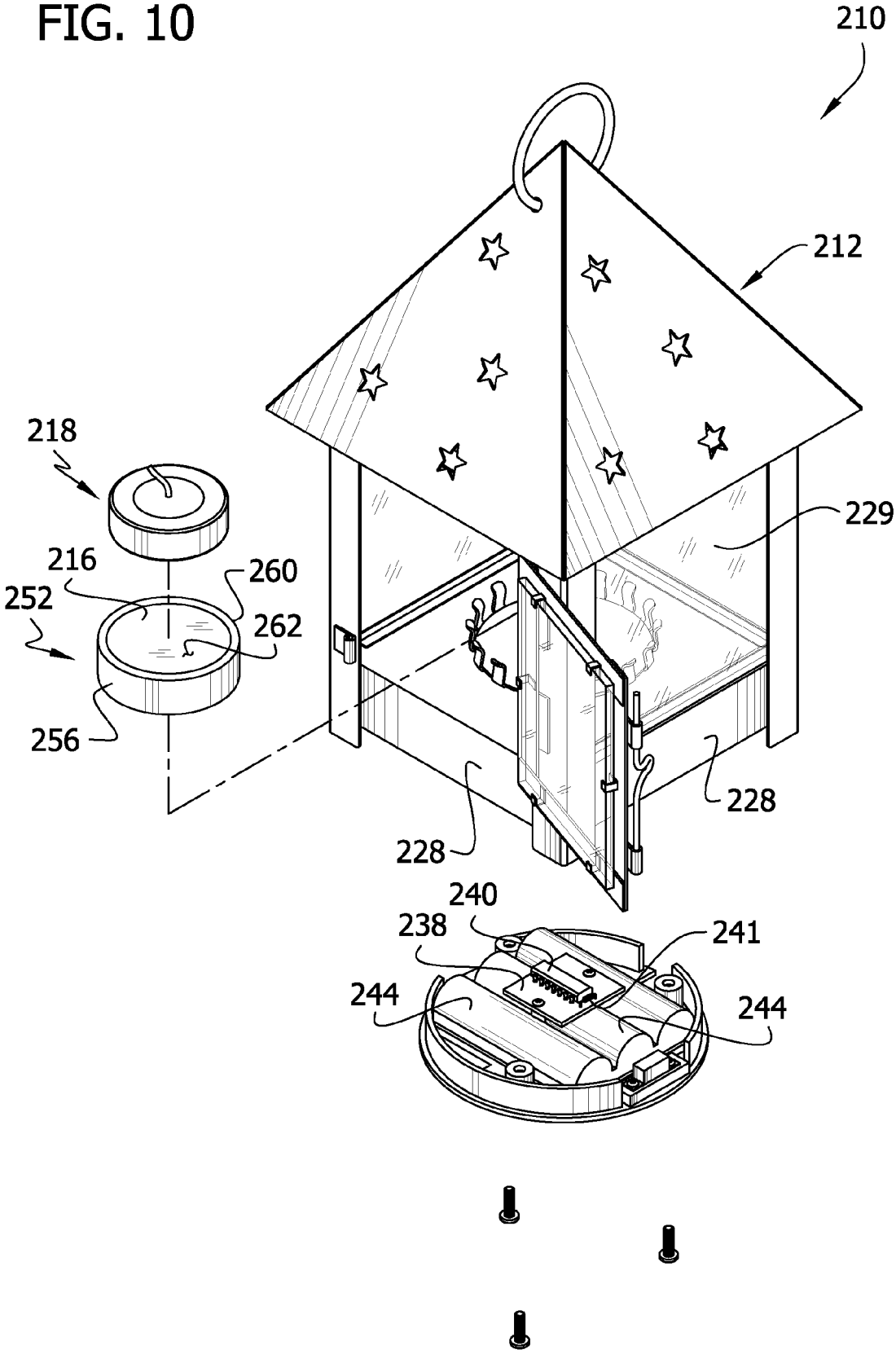
FIG. 10 is an exploded view of the third embodiment of the light emitting apparatus.

Referring to FIGS. 9 and 10, a third embodiment of a light-emitting apparatus is generally indicated at 210. This embodiment is similar to the second embodiment and therefore like components are indicated by corresponding reference numerals plus 100. The difference between the third embodiment and the second embodiment is that the housing 212 of the third embodiment is constructed as a lantern including side walls 228 with windows 229 to allow light to exit the housing 212. As with the second embodiment 110, the third embodiment 210 includes a candle support, generally indicated at 252, configured to both cover the LED 214 and support a candle 218 over the LED in the housing 212. The stand 252 is constructed similar to the stand 152 of the second embodiment and may be used in the same fashion as in the second embodiment.

Having described the invention in detail, it will be apparent that modifications and variations are possible without departing from the scope of the invention defined in the appended claims.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A light-emitting apparatus comprising:

a one-piece housing defining an interior space, the housing being entirely formed of wax;

a light-emitting diode in the interior space of the housing projecting upward from an interior bottom surface in the interior space; and a support surface defined by the housing and in the interior space above the light-emitting diode configured to support a candle in the interior space over the light-emitting diode so that the light-emitting diode is hidden from view.

2. A light-emitting apparatus as set forth in claim 1 further comprising a candle supported on the support surface, wherein the candle is removable from the interior space of the housing, and wherein the housing extends above the candle.

3. A light-emitting apparatus as set forth in claim 1 wherein the interior space includes an LED-receiving recess below the support surface, the light-emitting diode being disposed in the LED-receiving recess.

4. A light-emitting apparatus as set forth in claim 3 wherein the interior space includes a candle-receiving recess above the LED-receiving recess for retaining a candle therein, the candle-receiving recess being partially defined by the support surface.

5. A light-emitting apparatus as set forth in claim 4 wherein the housing defines an upper cavity disposed above the candle-receiving recess, wherein the upper cavity, the LED-receiving recess and the candle-receiving recess are generally coaxial.

6. A light-emitting apparatus as set forth in claim 1 wherein housing includes at least one battery receptacle for receiving at least one battery, wherein the battery receptacle is electrically connected to the light-emitting diode to power the light-emitting diode when said at least one battery is received in said at least one battery receptacle.

7. A light-emitting apparatus comprising:

a housing having an appearance of a candle, the housing having an interior space extending longitudinally through a top of the housing;

a cavity in the interior space of the housing having a first transverse dimension;

a support surface in the interior space of the housing for supporting a candle thereon, the support surface partially defining a candle-receiving recess disposed below the cavity;

an LED-receiving recess in the interior space of the housing and disposed below the support surface; and an LED in the LED-receiving recess.

8. A light-emitting apparatus as set forth in claim 7 wherein the candle-receiving recess has a second transverse dimension smaller than the first transverse dimension and the LED-receiving recess has a third transverse dimension smaller than the second transverse dimension.

9. A light-emitting apparatus as set forth in claim 7 in combination with a standard tealight candle supported on the support surface.

10. A light-emitting apparatus as set forth in claim 9 wherein the cavity extends above the standard tealight candle when the candle is supported on the support surface.

11. A light-emitting apparatus as set forth in claim 7 wherein the candle-receiving recess is generally cylindrical having a diameter within a range of about 1.5" and about 3.0".

12. A light-emitting apparatus as set forth in claim 7 wherein candle-receiving recess and the LED-receiving recess are generally coaxial and are generally coaxial with a longitudinal axis of the housing.

13. A light-emitting apparatus as set forth in claim 7 wherein the housing is a one-piece housing.

14. A light-emitting apparatus as set forth in claim 13 wherein the one-piece housing is entirely constructed of wax.

* * * * *